United States Patent [19]

Yamaguchi

[11] Patent Number: 4,884,906

[45] Date of Patent: Dec. 5, 1989

[54] SERIAL PRINTER WITH A SINGLE TYPE WHEEL

[75] Inventor: Morio Yamaguchi, Funabashi, Japan

[73] Assignee: Max, Co., Ltd., Tokyo, Japan

[21] Appl. No.: 160,756

[22] Filed: Feb. 26, 1988

[30] Foreign Application Priority Data

| | | | |
|---|---|---|---|
| Feb. 27, 1987 | [JP] | Japan | 62-28263[U] |
| Feb. 28, 1987 | [JP] | Japan | 62-29449[U] |
| Mar. 19, 1987 | [JP] | Japan | 62-40296[U] |

[51] Int. Cl.[4] ..... B41J 1/42

[52] U.S. Cl. ..... 400/162.3; 400/185; 400/634; 101/93.24

[58] Field of Search ..... 400/55, 160, 162, 162.3, 400/163.1, 163.2, 185, 187, 555, 568, 564, 570, 634, 636, 636.1; 101/93.18, 93.19, 93.21, 93.24, 93.25; 178/23, 32, 34, 35, 36, 38, 42

[56] References Cited

U.S. PATENT DOCUMENTS

| | | | |
|---|---|---|---|
| 1,594,573 | 8/1926 | Stallman | 400/162 |
| 2,817,428 | 12/1957 | Appelberg | 400/163.2 |
| 4,095,686 | 6/1978 | Okabe | 400/162.3 |
| 4,406,551 | 9/1983 | Maezawa et al. | 400/163.2 |
| 4,410,289 | 10/1983 | Koike et al. | 400/185 |
| 4,424,743 | 1/1984 | Okubo et al. | 101/93.22 |

FOREIGN PATENT DOCUMENTS

| | | | |
|---|---|---|---|
| 44-10342 | 4/1969 | Japan . | |
| 48-7855 | 3/1973 | Japan . | |
| 44827 | 3/1980 | Japan . | |
| 57-44828 | 3/1980 | Japan . | |
| 57-9949 | 2/1982 | Japan . | |
| 49587 | 3/1982 | Japan | 400/55 |
| 57-98852 | 6/1982 | Japan . | |
| 57-98853 | 6/1982 | Japan . | |
| 57-55077 | 11/1982 | Japan . | |
| 59-41556 | 3/1984 | Japan . | |
| 59-23015 | 7/1984 | Japan . | |
| 60-2930 | 1/1985 | Japan . | |
| 1546 | 1/1987 | Japan | 400/185 |
| 2179301 | 3/1987 | United Kingdom | 400/185 |

*Primary Examiner*—David A. Wiecking
*Attorney, Agent, or Firm*—Jones, Tullar & Cooper

[57] ABSTRACT

In a serial printer having a single type wheel, the type wheel is rotatably supported on a rocking frame, which is rockable relatively to a fixed frame, so as to be fixed with respect to the direction of the axis of rotation, and is rotated by means of a single drive motor. A drive transmission mechanism between the motor and the type wheel includes a main shaft rotatably supported by the rocking frame and a main cam rotatable in one with the main shaft. Each revolution of the main shaft and the main cam is divided into at least three rotational angular ranges, which are allotted individually for operation processes of type selection, printing, and sheet feed. All these processes are executed with use of the single drive motor as a drive source. A sheet holding mechanism continuously maintains a paper hold state until a specific character, such as an end mark, is printed after the start of a printing cycle. A printing sheet is held and released by means of the aforesaid drive motor as the drive source. The sheet feed pitch is adjusted in accordance with another specific character, such as a comma, and a sheet feed mechanism for the adjustment is driven by means of power transmitted through the main cam.

18 Claims, 12 Drawing Sheets

SERIAL PRINTER WITH A SINGLE TYPE WHEEL

BACKGROUND OF THE INVENTION

The present invention relates to a serial printer having a single type wheel and adapted for use in a checkwriter or a numbering machine, which prints an amount of money or other information on a printing sheet fed gradually along a print line with respect to the type wheel.

Printers of this type are so-called serial printers. The serial printers are discriminated from printers of the so-called parallel type or simultaneous-lever type, in which a number of type wheels are arranged along an axis, corresponding to individual columns. An example of the parallel type is disclosed in U.S. Pat. No. 4,424,743. Although it does not require column-by-column feed of a printing sheet, this parallel printer must use so many type wheels that it cannot be easily reduced in cost, and is bulky as a whole. Also, the type wheels of this printer must be subjected to a substantial rotational load.

The serial printers, on the other hand, are conventionally incorporated in checkwriters of the so-called manual rotary type, in which a series of operations, including a printing operation, is performed by manually rotating a type wheel.

Although the printers of this type have the advantage of inexpensiveness, they are low in operating efficiency and cannot produce prints of very high quality.

Accordingly, there have been proposed serial printers which are arranged so that such a series of operations are performed by means of a power drive system, e.g., a motor drive system. One such printer is disclosed in Japanese Utility Model Disclosure No. 59-41556.

According to these proposed printers, however, the type selecting operation, printing operation using a hammering mechanism, and sheet feed operation are performed with use of different drive means, such as stepping motors. Therefore, the internal mechanisms and control systems are complicated, and the use of the stepping motors, which are considerably expensive, spoils the advantages of the serial printers, i.e., inexpensiveness and compactness.

Electric numbering machines having a single type wheel are disclosed in U.S. Pat. No. 4,406,551, Japanese Utility Model Disclosure No. 57-98852, and Japanese Utility Model Publication No. 60-2930. These machines, however, also use pulse motors and a number of solenoid devices as their power sources. Although only one type wheel is used in these machines, moreover, it is designed so as to slide along its axis of rotation during the printing operation. Inevitably, therefore, the machines are bulky, and are subject to the same drawbacks of the foregoing proposed printers.

In one such conventional serial printer, e.g., one used in a checkwriter, an amount of money is printed in the following manner. First, the type wheel is rotated selectively to situate a desired type in a printing position. Then, "¥" or other monetary unit mark is printed in a first column position, figures in the subsequent positions, and "*" or other indelible end mark in the last position.

During the process of these printing operations, the type wheel is repeatedly pressed against and separated from the printing sheet for each process. In order to prevent the sheet from being dislocated when the type wheel is disengaged therefrom, the printer of this type is provided with a sheet holding device. The holding device includes sheet holding rollers which are adapted to be pressed against the sheet during the printing operation, and to be disengaged from the sheet when the last end mark is printed.

An example of such a prior art sheet holding device is disclosed in Japanese Utility Model Publication No. 59-23015. In this sheet holding device, the sheet holding rollers are expected to be expressly set in a sheet holding position by a user's operation of a manual lever. When the end mark is printed, in this case, a release lever is operated to release the set rollers.

According to this arrangement, however, the sheet holding rollers must be set manually, thus requiring troublesome operation.

Alternative arrangements have been proposed in which the sheet holding rollers are disengaged from the sheet with the use of a separate power drive means. Disclosed in Japanese Patent Publication No. 57-55077, for example, is an arrangement such that the sheet holding rollers are disengaged by using a cam member having two cam surfaces, and the disengaging operation is controlled by means of an electromagnet. In an arrangement disclosed in Japanese Patent Publication No. 57-9949, moreover, a drive lever for sheet holding is set by means of a clutch-operated rotary cam, and is released or returned by means of a separated release cam. In either case, however, a drive mechanism for sheet holding must be provided independently of a printing drive system, thus making the printer more complicated and large-sized.

In gradually feeding the printing sheet along the print line to each printing position, in the serial printer of this type, a known mechanism is used for adjusted sheet feed, e.g., half-pitch feed, whose feed pitch is different from the regular feed pitch for the printing of figures and other regular characters. The half-pitch sheet feed is performed in printing a comma or other specific character, in order to prevent corruption and improve the appearance of the print.

As prior art examples, printers of the so-called manual rotary type are disclosed in Japanese Utility Model Publication Nos. 44-10342 and 48-7855. In these printers, a type wheel is set and depressed manually.

According to the arrangement of these printers, however, the printing process is followed by a resetting process in which the type wheel is rotated to be returned to its initial position. If a sheet feed process is tried simultaneously with the resetting process, therefore, the set state of the type carrying the comma or other specific character will be changed by the rotation of the type wheel. Thus, it is hard to adjust the sheet feed pitch in time with the set state.

SUMMARY OF THE INVENTION

The present invention has resulted from a consideration of these circumstances, and its principal object is to provide a serial printer with a single type wheel, which is simple in construction, low-priced, easy to miniaturize, and adapted for use in a checkwriter or the like, and in which a series of operations, including type selection, printing, sheet feed, etc., is performed based on power drive.

In order to achieve the above object, according to the present invention, there is provided a serial printer which comprises a basic frame structure including a fixed frame, and a rocking frame supported by the fixed frame and rockable relatively to the fixed frame between a first position, in which a passage for a printing sheet, defined between the fixed and rocking frames, is opened to allow the printing sheet to be inserted freely thereinto, and a second position, in which the rocking frame can rock relatively to the fixed frame. A single type wheel is supported on the rocking frame, and is rotated by means of a single drive motor through the medium of rotary drive transmission means. The rotary drive transmission means includes a main rotating member having at least three separate rotational angular ranges, including first, second, and third ranges, within an entire turn thereof.

In such an arrangement according to the present invention, processes of operation for type selection, printing, and sheet feed can be accomplished with use of a single drive motor as a power drive source. Thus, these operation processes are performed in succession within their corresponding rotational angular ranges in each turn of the main rotating member located between the drive motor and the type wheel.

Accordingly, the printer of the invention can be easily made smaller in size and lighter in weight, as a whole, than the conventional ones which use separate drive sources for the individual operating processes. Moreover, a low-priced DC motor, capable of producing high output torque, can be used as the drive motor, instead of using an expensive stepping motor. Thus, various effects can be obtained, including ease of low-cost design.

Another object of the present invention is to provide a serial printer using a single type wheel, which is provided with a sheet holding mechanism capable of performing sheet holding and releasing operations in association with the printing operation, without requiring any complicated means or operations, so that the printer is simpler in construction, less expensive, and smaller in size, as a whole.

In order to achieve the above object, according to the present invention, a position setting member for controlling an up position of the rocking frame, with the type wheel thereon, is attached to one of the rocking frame and the fixed frame so as to be situated between the frames, and a retaining member adapted to cooperate with the position setting member is attached to the other of the frames. The position setting member is shifted between first and second shift positions in association with the printing operation. Accordingly, a paper hold state can be maintained continuously during a time interval from the start of the printing operation to a printing cycle for a specific character, such as an end mark, without providing any special manual operation mechanism or power drive system. When a type carrying the specific character is situated corresponding to a printing position, moreover, the paper hold state can be released automatically. Thus, there may be provided a compact, low-priced serial printer which has a simple construction, and does not require any special operation.

Still another object of the present invention is to provide a serial printer having a sheet feed mechanism which can perform the sheet feed operation with the type wheel fully separated from the printing sheet, and in which a sheet feed pitch adjusted corresponding to a specific character, such as a comma, can be set securely.

In order to achieve the above object, the sheet feed mechanism is designed so as to cooperate with the main rotating member within the third rotational angular range of the rotating member, thereby performing the sheet feed operation to feed the printing sheet in the sheet passage along a print line. The sheet feed mechanism is provided with sheet feed drive means for producing a fixed operation stroke corresponding to a predetermined sheet feed pitch. The drive means includes a sheet feed control member movable between an adjustment position, in which the drive means adjust the operation stroke to change the sheet feed pitch, and a nonadjustment position in which the adjustment cannot be effected.

In the arrangement described above, a type detection member is used to detect that a type carrying the comma or other specific character is situated in the printing position. On detecting this, the detection member shifts its position, thereby moving the sheet feed control member to the position where it engages restriction means, which restricts the control member to the adjustment position while the control member is executing the sheet feed operation. Even though the type wheel rotates in a so-called resetting process such that it returns to its original position, thereby restoring the type detection member from the shifted position, therefore, operation for adjusted sheet feed, such as half-pitch feed, can be securely accomplished without being influenced by the returning action. Accordingly, the sheet feed operation can be started at a point of time when the type wheel is separated completely from the printing sheet after the end of the printing operation. Therefore, the sheet can never be soiled by rubbing against the type wheel, nor suffer dislocation of prints. Thus, the sheet feed operation can be improved in accuracy to ensure higher print quality. Moreover, the processes of sheet feed operation can be controlled automatically by means of a mechanical system, without requiring any electrical means for detection or control. As a consequence, there may be provided a serial printer which enjoys various effects or advantages, including simple construction, low cost, easy maintenance, high durability, etc.

The above and further objects, details and advantages of the present invention will become more apparent from the following detailed description, when read in conjunction with the accompanying drawings.

DETAILED DESCRIPTION OF THE PREFERRED EMBODIMENT

Figure 1:
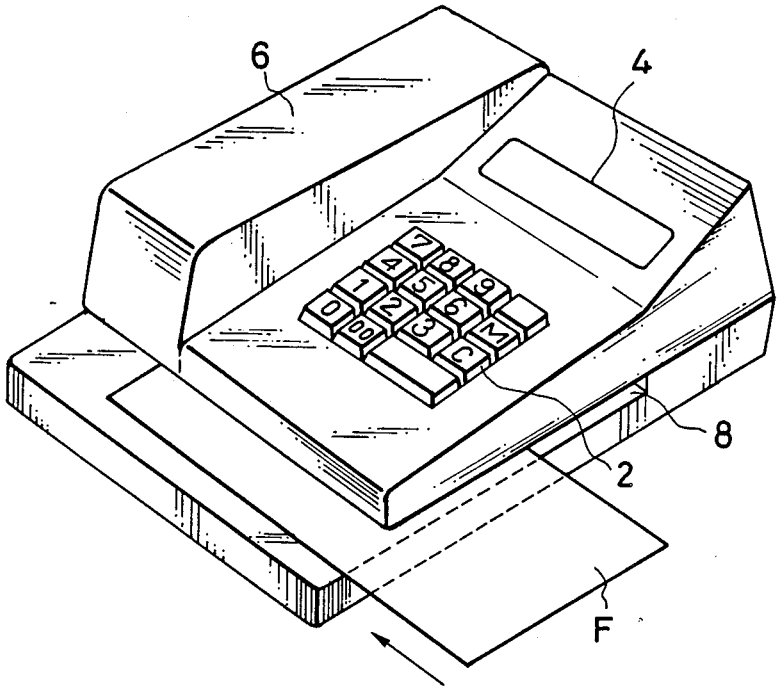
FIG. 1 is an external perspective view of a checkwriter exemplifying a serial printer according to the present invention.

FIG. 1 shows an outline of a checkwriter to which is applied a serial printer according to an embodiment of the present invention. The checkwriter comprises an input section 2, composed of function keys including numerical keys for inputting the amount of money or other numerical information, issue key, memory key, etc., and a display section 4 for displaying the inputted figures. The serial printer is disposed inside a printing section 6 beside the sections 2 and 4.

In operating the printer in an initial state, a printing sheet F, such as a check or receipt, is first inserted into a sheet passage 8. In this state, printing data, such as an amount of money, is inputted through the input section 2. After ascertaining the input data at the display section 4, the issue key is depressed. Thereupon, the data is printed on the sheet F. During this printing operation, the sheet F is fed for each column along a print line in the direction indicated by the arrow.

Figure 2:
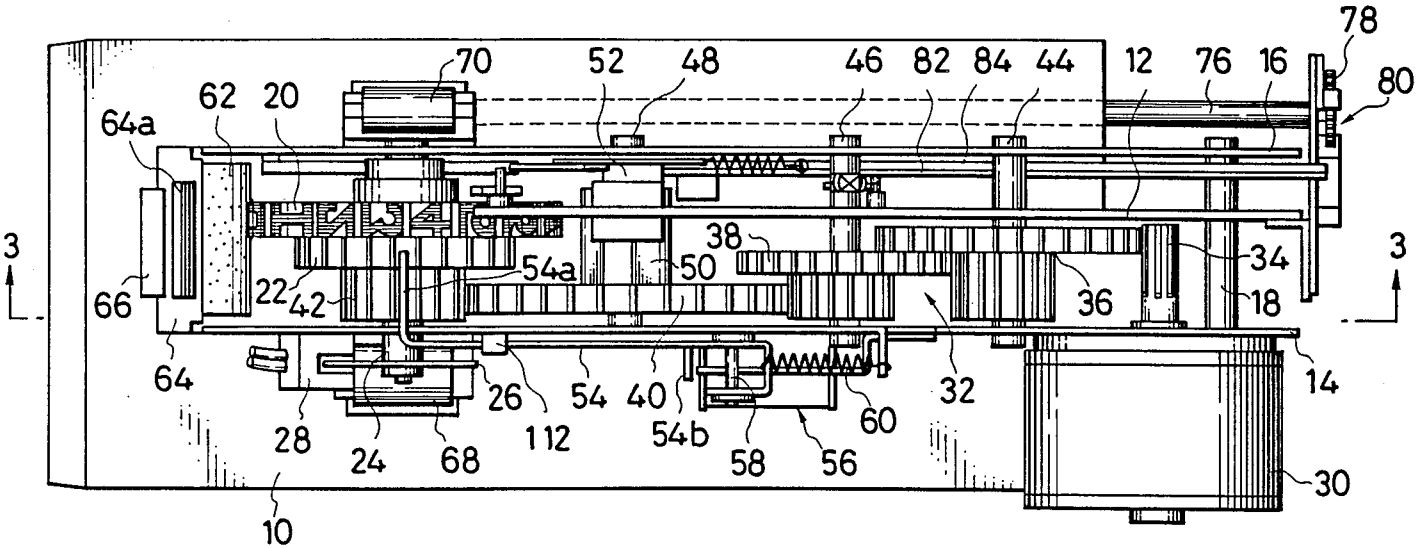
FIG. 2 is a top view of the serial printer of the invention.

FIG. 2 is a top view showing an internal mechanism of the serial printer, which is exposed by removing the cover of the printing section 6. In FIG. 2, numeral 10 denotes a horizontal base for guiding the printing sheet, and numeral 12 denotes a fixed frame which, fixed upright on the base 10, constitutes a housing of the printer. Numerals 14 and 16 designate a pair of rocking frames arranged on either side of the fixed frame 12 in parallel relation.

The rocking frames 14 and 16 are fixed integrally to each other, at their respective one end portions, by means of a support shaft 18, and are also rockably supported on one end portion of the fixed frame 12 by means of the shaft 18.

Numeral 20 denotes a type wheel having printing types on its peripheral surface; 22, a ratchet wheel for type selection integral with the type wheel 20; and 24, a support shaft rotatable in one with the type wheel 20. The type wheel 20 is supported by the shaft 24 so as to be rotatable but axially fixed in the vicinity of the free ends of the rocking frames 14 and 16. Numeral 26 denotes a detecting disk fixed to one end portion of the support shaft 24, while numeral 28 designates a photosensor mounted on the rocking frame 14. The photosensor 28 constitutes optical detection means which, in conjunction with the disk 26, delivers timing pulses corresponding to the positions of the individual types.

Numeral 30 denotes a single drive motor which, composed of a DC motor, is used to drive the serial printer. The drive motor 30 is supported in the vicinity of the base end portion of the rocking frame 14. The driving force of the motor 30 is transmitted to the type wheel 20 through rotation transmission means 32 which is composed of a gear train. The gear train includes a minor gear 34 formed on the shaft of the motor 30, first and second intermediate gear assemblies 36 and 38, a main gear 40, and a type wheel gear 42, successively in mesh with one another. All these gears are arranged between the two rocking frames 14 and 16.

The rotating speed ratio of the minor gear 34 to the main gear 40 is set to a reduction ratio of 45 to 1, such that the main gear 40 makes one revolution while the motor shaft makes 45 revolutions. The speed ratio of the main gear 40 to the type wheel gear 42 is set to an accelerating ratio such that the type wheel gear 42 makes three revolutions while the main gear 40 makes one revolution.

The two intermediate gear assemblies 36 and 38 are rotatably supported between the rocking frames 14 and 16 by means of support shafts 44 and 46, respectively. The main gear 40 is mounted on a main shaft 48 which rotates in one therewith. The main shaft 48 is rotatably supported between the rocking frames 14 and 16. The main shaft 48 is formed integrally with a main cam member 50 constituting cam means and a driving cam member 52 for driving an operating lever 126 for half-pitch setting (mentioned later). The main gear 40, main shaft 48, main cam member 50, and driving cam member 52 constitute a main rotating member.

Figure 3:
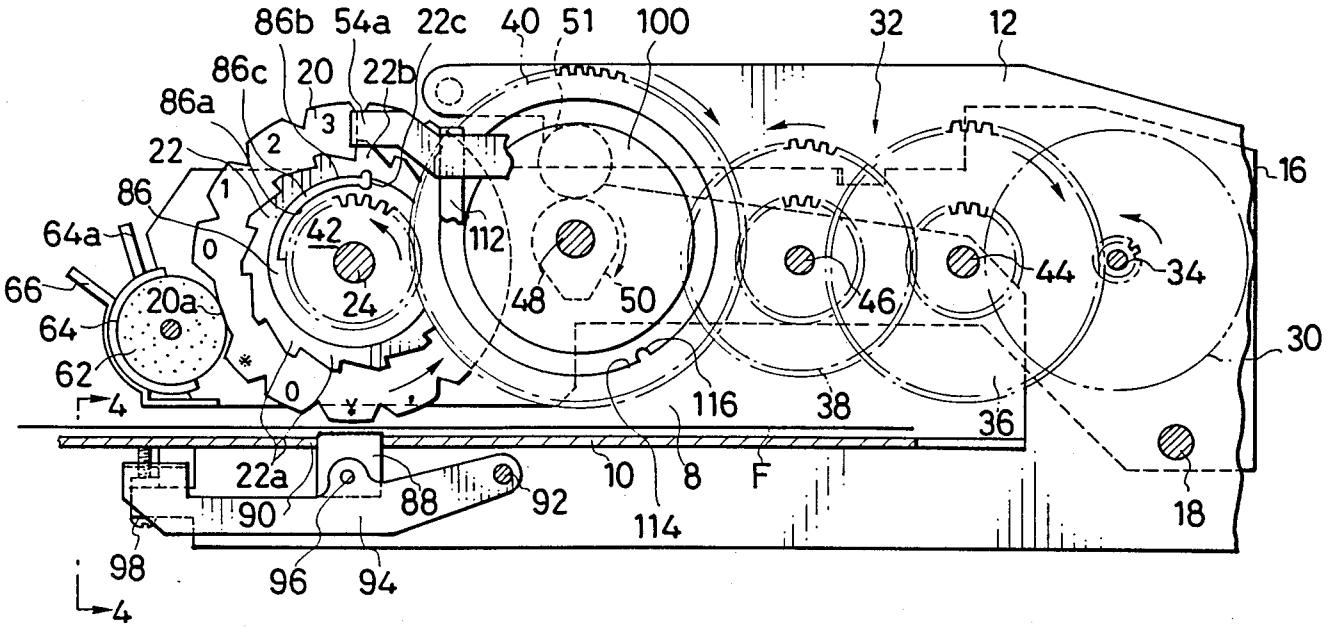
FIG. 3 is a vertical sectional view taken along line 3—3 of FIG. 2.

When the ratchet wheel 22, which is integral with the type wheel 20, is released from a stopper lever 54, as mentioned later, the type wheel 20 rotates in one with the gear 42 in a manner such that an engaging projection 86*b* is in engagement with an engaging recess 22*c* of the wheel 22 (FIG. 3).

When the wheel 22 is stopped by the stopper lever 54, the projection 86*b* is disengaged from the recess 22*c* and a resilient engaging member 86, which is integral with the gear 42, slips on the inner peripheral surface of the wheel 22. Thereupon, the gear 42 is allowed to rotate relatively to the type wheel 20.

Thus, the rotating speed ratios between the drive motor 30, main shaft 48, cam members 50 and 52, and type wheel 20 are in the same relationships as aforesaid. All these members rock together with the rocking frames 14 and 16.

Since all the members of the drive system, ranging from the drive motor 30 to the type wheel 20, are disposed on the rocking frames 14 and 16, they can be designed correspondingly with ease. Also, this arrangement does not require a complicated coupling mechanism, and can easily enjoy high dimensional accuracy. At the time of assembling, moreover, the drive system can be previously mounted together with the rocking frames 14 and 16 to form a single unit. Thus, the assembly work and maintenance are easy.

Further, an operating bar 82 for sheet feed, a control bar 84 for half-pitch feed, etc. (not shown), are supported on the aforesaid unit structure. Thus, a sheet feed mechanism and the like, associated with the drive system, can be mounted and adjusted with ease.

As the rocking frames 14 and 16 are supported on the fixed frame by means of the support shaft 18, a cam follower 51, which is mounted on the free end portion of the fixed frame 12 and is in rolling contact with the main cam member 50, automatically follows the action of the member 50. Thus, a fine adjustment is not required between the moving and fixed sides.

Depending on the design, the drive motor 30 may be mounted on the printer housing without damaging the drive transmission system.

The aforementioned stopper lever 54 has one end portion 54*a* which selectively engages the ratchet wheel 22 for type selection. An armature 54*b* at the other end portion of the lever 54 corresponds in position to a solenoid device 56. The stopper lever 54 is rockably supported on the rocking frame 14 by means of a pivot 58, and is urged by a spring 60 in a direction such that it is disengaged from the ratchet wheel 22. Thus, a type selection mechanism is constructed.

The solenoid device 56, which is also mounted on the rocking frame 14, uses a so-called direct drive system such that the stopper lever 54 is pulled directly at the time of type selection.

Numeral 62 denotes an ink roller, which is detachably mounted on the free end portions of the rocking frames 14 and 16 by means of a roller holder 64 having a handle 64*a*. The roller 62 can be removed from the frames 14 and 16, resisting the urging force of a leaf spring 66. In the mounted state as illustrated, the ink roller 62 faces and touches the type wheel 20 in order to supply ink thereto.

Numerals 68 and 70 denote upper sheet holding rollers which are rotatably mounted on the rocking frames 14 and 16, respectively. A lower feed roller (not shown) and a feed drive roller 74 (see FIG. 7), which are mounted on the printer housing, correspond to the rollers 68 and 70, respectively.

The sheet holding rollers 68 and 70 are attached to their corresponding rocking frames 14 and 16 by means of brackets, each in the form of a leaf spring capable of minor elastic deformation, in a manner such that the rollers 68 and 70 project somewhat below the type wheel 20.

Figure 5:
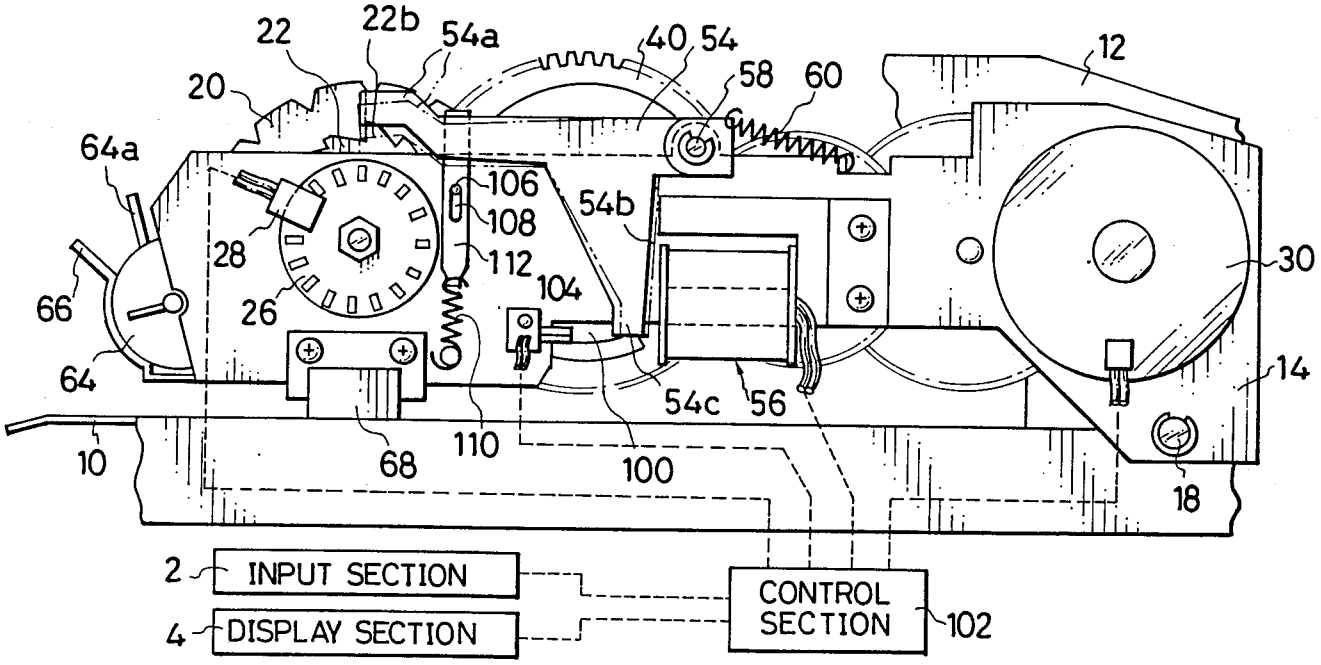
FIG. 5 is a front view corresponding to FIG. 2.
Figure 9:
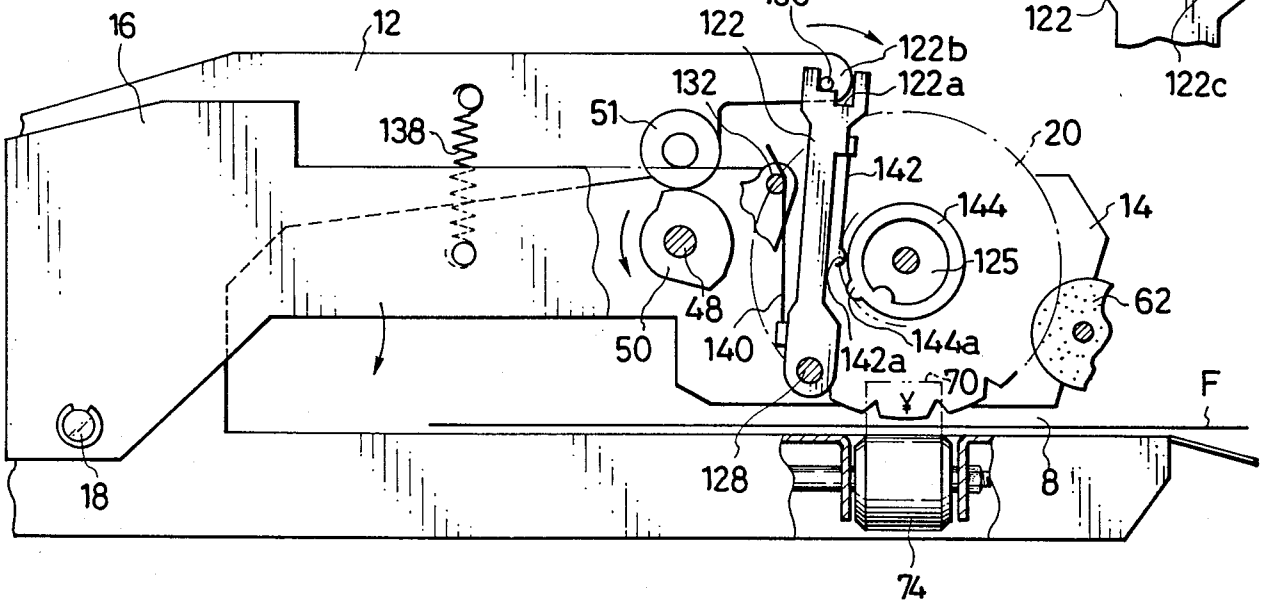
FIG. 9 is a rear view for illustrating the operation of the printer shown in FIG. 7.

When the rocking frames 14 and 16 are lowered from a first position or up position (FIG. 7), the sheet holding rollers 68 and 70 first touch their corresponding lower feed rollers, thereby holding the sheet F inserted in the sheet passage 8. Thus, a paper hold state is established (FIGS. 3, 5 and 9). When the rocking frames 14 and 16 are in a second position or down position, the type wheel 20 is kept freely rotatable for type selection or reset rotation.

In starting a printing operation, the type wheel 20 is pressed against the sheet F by further lowering the rocking frames 14 and 16 from the second position to a position on the opposite side thereof to the first position. In doing this, the sheet holding rollers 68 and 70 are kept in the paper hold state, and the brackets supporting these rollers undergo elastic deformation, thereby allowing the rollers 68 and 70 to move relatively to the rocking frames 14 and 16.

The drive roller 74 is fixed to one end of a transmission shaft 76, the other end of which extends to the base end portion of the fixed frame 12. A ratchet wheel 78 for sheet feed is mounted on the other end of the shaft 76, whereby the shaft 76 is coupled operatively to a sheet feed mechanism 80.

Numerals 82 and 84 denote the operating bar for sheet feed and the control bar for half-pitch feed, respectively, which constitute sheet feed drive means of the sheet feed mechanism 80. The operation of these bars will be described later.

As the drive motor 30 rotates in the direction of the arrow shown FIG. 3, its driving force is transmitted to the type wheel 20 through the gear 34, connected directly to the motor 30, and the other gears.

In conjunction with the cam follower 51 on the fixed frame 12, the main cam member 50, which rotates in one with the main shaft 48, rocks the rocking frames 14 and 16, as mentioned later, and constitutes a printing mechanism for printing operation.

In the initial state as illustrated, the stopper lever 54 engages a reference tooth 22*b* which projects radially outward from a series of teeth 22*a* formed corresponding to the individual types of the type wheel 20, on the outer periphery of the ratchet wheel 22. Thus, the type wheel 20 is held in its reference position.

In this initial state, a monetary unit mark ( ), among other individual types on the type wheel, is situated in the printing position where it faces a printing stump 88 (mentioned later), as shown in FIG. 3. Following this mark, a comma (,), figures (9 to 0), a notch 20*a*, an indelible end mark (*), and a blank or an auxiliary figure (zero in this embodiment) are arranged successively in the rotating direction of the type wheel 20, as indicated by the arrow.

The type wheel gear 42 and the ratchet wheel 22, which constitute a friction clutch, are in frictional engagement with each other through the medium of the resilient engaging member 86 which is formed integrally with the gear 42. The engaging member 86 includes a resilient piece 86*c* which defines a slit 86*a* and has an engaging projection 86*b* at an extreme end thereof. When the type wheel 20 is in the reference position or is rotating for type selection, the engaging projection 86 *b* is fitted in the engaging recess 22*c* in the inner peripheral surface of the wheel 22. Thus, during the type selection, the type wheel 20 and the gear 42 rotate in one.

When the type wheel gear 42 is rotated by the main gear 40 in a state such that the wheel 22 is stopped at a position for type selection by the stopper lever 54 after the type selection, however, the projection 86*b* is disengaged from the recess 22*c*. As a result, a slip is caused, so that only the gear 42 rotates on the support shaft 24.

When the type wheel 20 is in the reference position, as shown in FIG. 3, the notch 20*a* on its outer periphery corresponds in position to the ink roller 62. Thus, the roller 62 is prevented from being continually in contact with a specific type.

Application of ink by means of the ink roller 62 will be described. While the type wheel 20 is rotating in the direction of the arrow from the reference position of FIG. 3, after the start of type selection, the ink is applied to the face of each type in sliding contact with the roller 62. Thus, if the end mark (*) or the like, which need not be printed at first, is located between the monetary unit mark ( ) and the notch 20*a*, an uninked type cannot be worked first.

The ink is also applied in the aforesaid manner when the type wheel 20 is returned to the reference position.

Alternatively, the ink roller 62 may be designed so as to be separated completely from the type wheel 20 when it is not working, and to be moved close to the wheel 20 as the rocking frames 14 and 16 rock for the printing operation. In this arrangement, the type wheel 20 need not be provided with the notch 20*a*, so that an additional type can be used in place of it.

As shown in FIG. 3, the fixed frame 12 and the rocking frame 16 are substantially U-shaped so that the sheet passage 8 defined by these frames can extend as deep as possible. Even if the printing sheet F has a substantial width, therefore, printing can be effected on any desired portion of the sheet.

Figure 4:
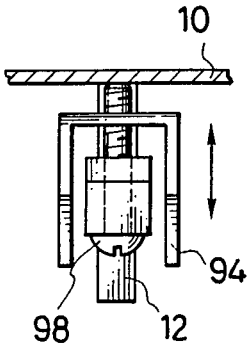
FIG. 4 is a partial sectional view taken along line 4—4 of FIG. 3.

Embossment printing is performed on the printing stump 88, which is exposed from a window portion of the base 10 so as to oppose the type wheel 20. The printing stump 88 is pivotally supported by means of a support shaft 96 on a retaining member 94, which, situated under the base 10, is rockably supported on the fixed frame 12 by means of a support shaft 92. As is also shown in FIGS. 3 and 4, the free end portion of the retaining member 94 engages an adjust screw 98 which is attached to the fixed frame 12.

Thus, the elevation of the printing stump 88 can be adjusted by changing the depth of engagement of the screw 98. Since the stump 88 can rock around the single support shaft 96, it can be adjusted so as to come intimately into contact with the face of the selected type of the type wheel 20 lowered for the printing operation. Thus, uniform and clear printing can be effected despite the variation in configuration of the type faces.

The retaining member 94 is in the form of parallel levers supporting the printing stump 88 on either side thereof.

A printed board 100 (mentioned later) for detecting the rotational position of the main shaft 48 is fixed to a lateral face of the main gear 40.

In FIG. 5, a control section 102 for the electrical control of various parts of the printer is connected electrically with the drive motor 30, the solenoid device 56, the photosensor 28 of the optical detection means, and a control switch 104. The switch 104, which is in sliding contact with the printed board 100 on the flank of the main gear 40, delivers various control pulses with set timing. Correlative operations of the mechanisms in the printer are controlled by means of the control section 102.

The control section 102 is further connected electrically with the input section 2 and the display section 4 of the checkwriter, so that the operations of these sections and the printer are controlled correlatively.

When the stopper lever 54 is not pulled by means of the solenoid device 56, it is supported by the rocking frame 14 in a manner such that a pin 106 and a slot 108 engage each other. Also, the lever 54 is held in its original position, as indicated by the full line in FIG. 5, by means of a position retaining member 112, which is resiliently held in the illustrated position by means of a spring 110.

When the stopper lever 54 is pulled, on the other hand, it rocks to the type selection position, indicated by the chain line, resisting the urging force of the spring 60. As is clearly shown in FIG. 6, an end portion **54*c* of the stopper lever 54 can engage two engaging projections 116 and 118 which protrude from those portions of an annular recess 114 in the lateral face of the main gear 40 which are situated at predetermined angular positions. The one projection 116, which is larger in size than the other projection 118, engages the end portion 54*c* immediately after the start of the type selecting operation of the printer, thereby pushing up the lever 54 against the retaining member 112, from the original position. Thus, the lever 54 is disengaged from the reference tooth 22*b* of the wheel 22, thereby allowing the type wheel 20** to be rotated for the type selection.

The other projection 118, which will be described in detail later, serves to push up the stopper lever 54, attracted to the type selection position by means of the residual magnetic force of the solenoid, to the original position, thereby disengaging the lever 54 from the type wheel 20.

Figure 6:
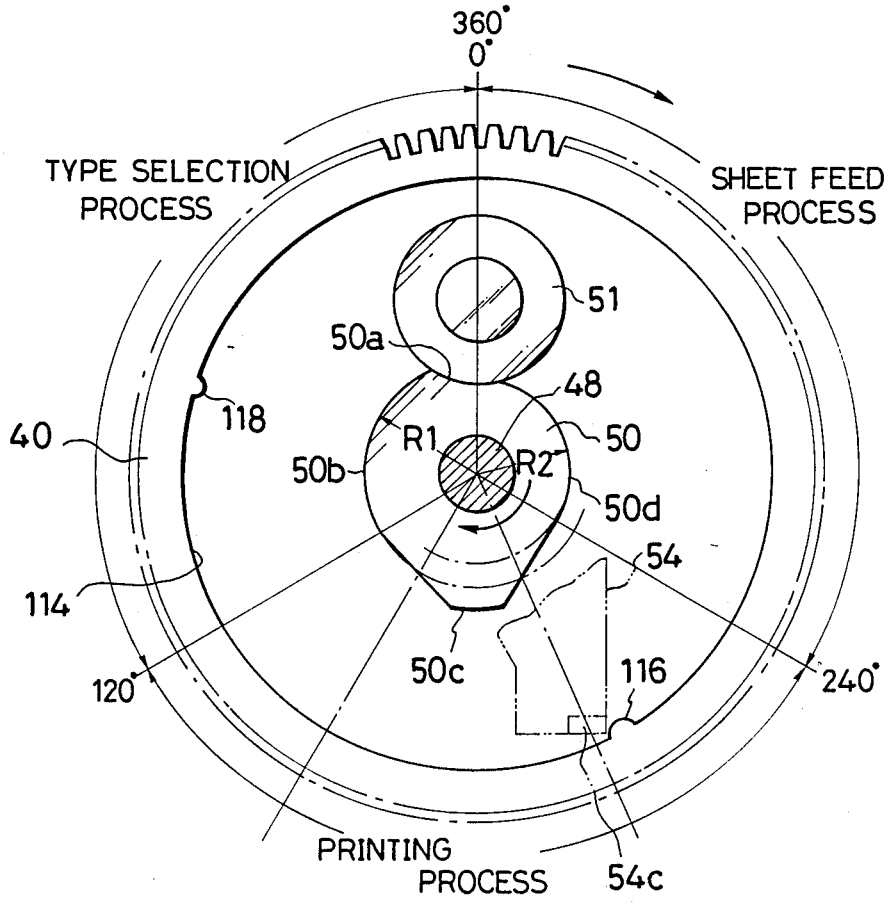
FIG. 6 is an enlarged view showing a principal mechanism including a main shaft, main cam member, main gear, etc.

As shown in FIG. 6, each revolution of the main rotating member, which is composed of the main axis 48, the main gear 40, and the main cam member 50, is divided into three regular rotational angular ranges (of 120° in this embodiment), i.e., first, second, and third ranges. The first, second, and third ranges are allotted for a type selection process, a printing process, and a sheet feed process, respectively. In parallel with the sheet feed process, a resetting process is performed such that the type wheel 20 is returned to the reference position. Thus, the ratchet wheel 22 is stopped at the reference position by the stopper lever 54, and the type wheel gear 42 is rotated to a predetermined position (FIG. 3) relative to the type wheel 20. In this position, the engaging projection **86*b* is fitted in the engaging recess 22*c*. In this manner, the positional relationship between the type wheel 20 and the gear 42** is restored to the initial state.

Thus, while the main shaft 48 makes one revolution, these processes of operation are executed in succession with use of the single drive motor 30 as the drive source.

Figure 15:
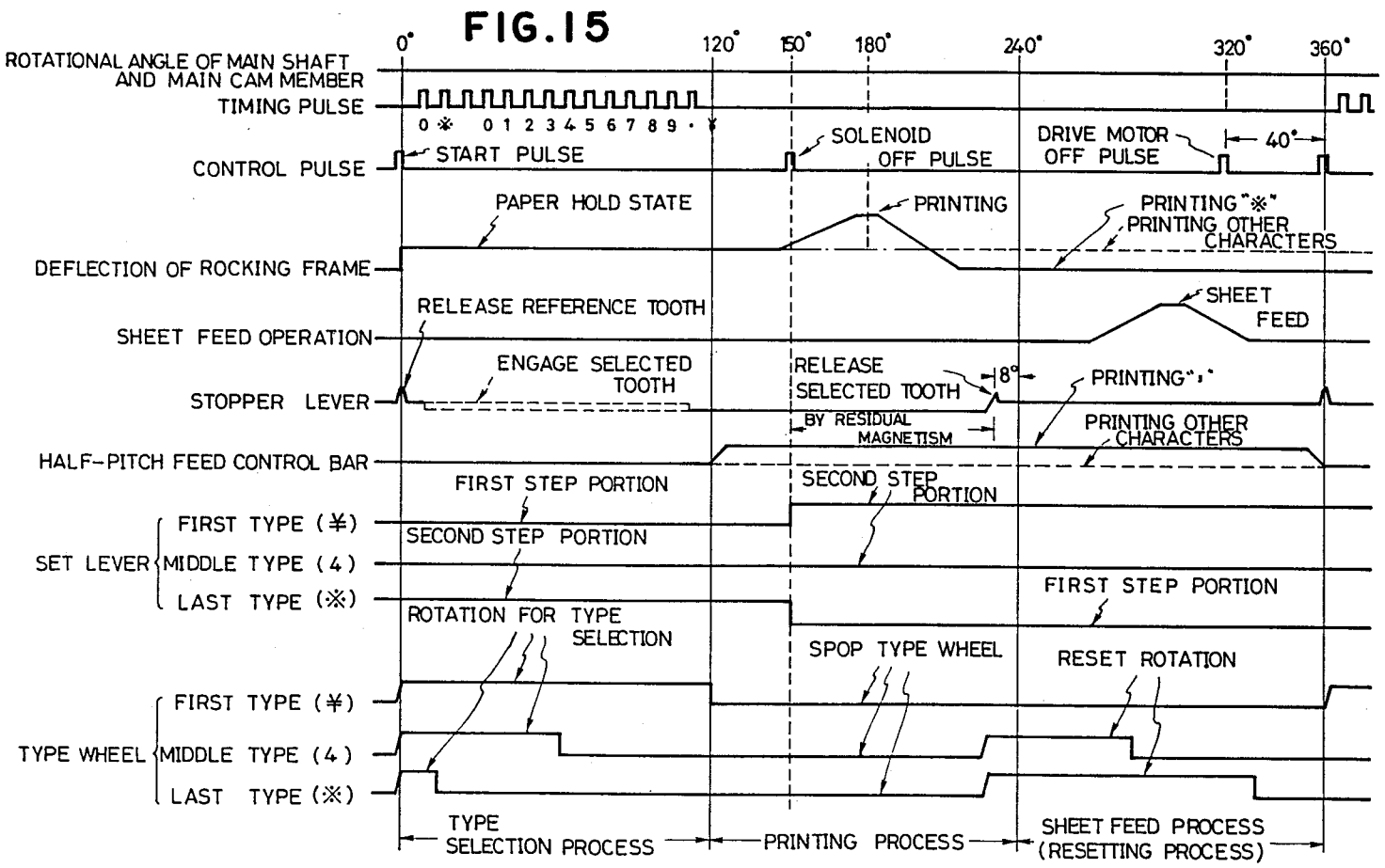
FIG. 15 is a timing chart for illustrating individual processes of operation of the printer.

The modes of operation in the aforesaid three processes are shown in the timing chart of FIG. 15.

Individual items in the left-hand columns of this timing chart will be described later. A control pulse to turn off the solenoid, among other control pulses to be delivered by means of the control switch 104, is delivered immediately after the start of the printing operation. As a result, the solenoid device 56 is deenergized. During the printing operation, thereafter, the stopper lever 54 is held in the selection position.

Thus, a yoke and a core of the solenoid device 56, the stopper lever 54, etc., may be formed of a material which is somewhat susceptible to residual magnetism, e.g., SPCC, SPHC, etc. Accordingly, the apparatus can be reduced in cost, and the conduction time of the solenoid can be shortened.

The main cam member 50 has a dwell cam surface **50*a*, an urging cam surface 50*b*, a printing cam surface 50*c*, and a resetting cam surface 50*d*. When the cam member 50 is in its initial position, the dwell cam surface 50*a* touches the cam follower 51, thus serving as detent means for positioning the member 50. The urging cam surface 50*b*, which has a uniform radius R1, corresponds to the type selection process and the initial stage of the printing process. The printing cam surface 50*c* corresponds to the middle stage of the printing process. The resetting cam surface 50*d*, which has a uniform radius R2**, corresponds to the final stage of the printing process and the sheet feed process (resetting process).

The printing cam surface **50*c* cooperates with a cam follower 120 (FIG. 7) for sheet feed, which is situated in an angular position at an angular lag of 120° from the cam follower 51, with respect to the cam member 50**, as described in detail later. By this cooperation, the sheet feed process is executed.

The radius R2 of the resetting cam surface **50*d* is a little shorter than the radius R1 of the urging cam surface 50*b***.

In the present embodiment, as has been described specifically with reference to FIG. 6, each revolution of the main rotating member, including the main shaft 48 and the like, is divided into three equal angular ranges. Alternatively, however, these angular ranges may be different from each other. Further, the resetting process and the sheet feed process may be executed within another or fourth angular range. In any case, according to the present invention, at least three rotational angular ranges are set dividedly.

Figure 7:
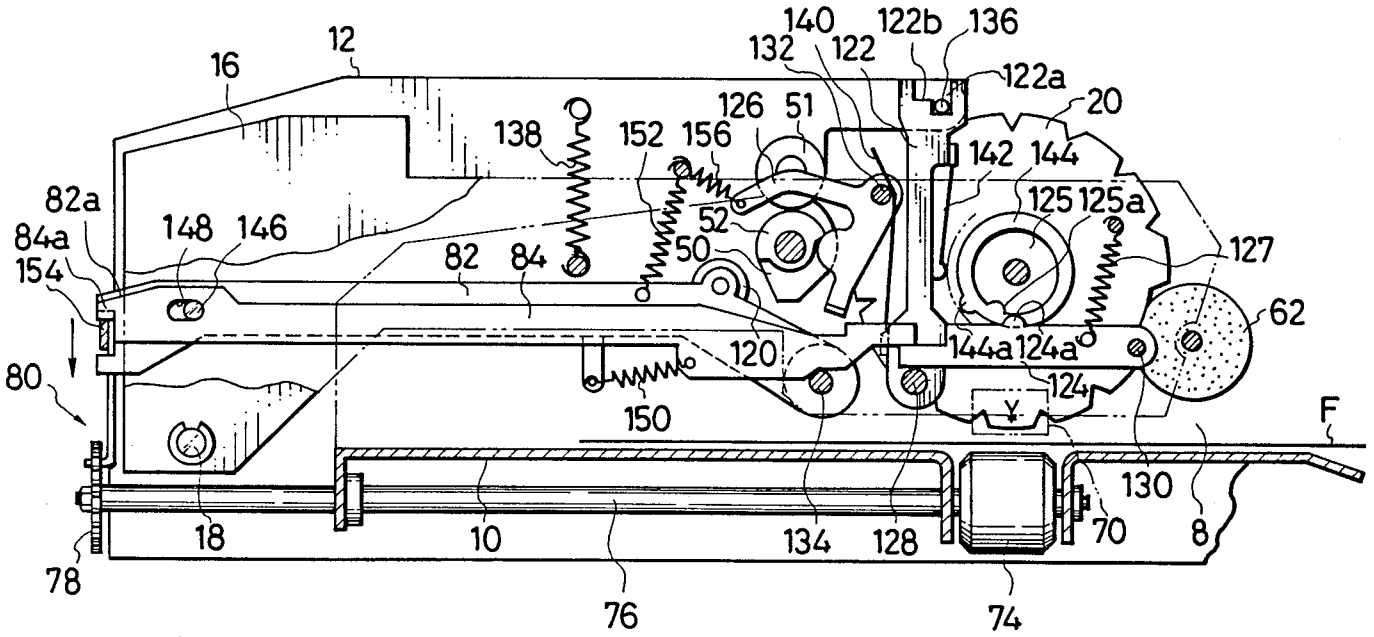
FIG. 7 is a rear view corresponding to FIG. 2.

As shown in FIG. 7, a set lever 122 constituting a position setting member, a trigger lever 124, the operating lever 126 for half-pitch setting, and the operating bar 82 for sheet feed are pivotally mounted on the rocking frame 16 by means of support shafts 128, 130, 132 and 134, respectively.

The set lever 122 is formed, at the upper end portion thereof, with first and second step portions 122*a* and 122*b* and a vertical portion 122*c*. The step portions 122*a* and 122*b* alternatively engage a stop pin 136 which protrudes from an end portion of the fixed frame 12. The vertical portion 122*c* defines one side of the first step portion 122*a*.

The stop pin 136 constitutes a retaining member which, in conjunction with the set lever 122 constituting the position setting member, controls the up-and-down motion of the rocking frames 14 and 16.

A pair of leaf springs 140 and 142, each in the form of a cantilever, are mounted on the opposite flanks of the set lever 122 so as to extend in opposite directions. The one leaf spring 140 constitutes first urging means for urging the set lever 122 in the clockwise direction. The upper or free end of the spring 140 is anchored to the support shaft 132 of the lever 126, thereby applying a clockwise urging force to the set lever 122. The other leaf spring 142 has a projection 142*a* at its lower or free end, which is opposed to the peripheral surface of a cam member 144 rotating in one with the type wheel 20. A projection 144*a* protrudes from a predetermined position on the peripheral surface of the cam member 144. The cam member 144, having the projection 144*a*, constitutes second urging means which, in conjunction with the leaf spring 142, urges the set lever 122 counterclockwise against the urging force of the leaf spring 140.

When the stop pin 136 is in engagement with the first step portion 122*a*, as shown in FIG. 7, the rocking frames 14 and 16 are held in the first or up position as illustrated. More specifically, when the sheet feed rollers 68 and 70, along with the type wheel 20, are disengaged from their corresponding lower feed rollers so that the printing sheet F can be inserted freely into the sheet passage 8, the passage 8 is open, and the rocking frames are held in the up position by means of a lift spring 138. Thus, the printer is in a nonprinting or initial state. At this time, the set lever 122 is in its first shift position as illustrated. In this up position, the projection 142*a* of the leaf spring 142 is situated at a distance substantially equivalent to the height of a projection 144*a* of the cam member 144, from the peripheral surface of the cam member 144. Thus, the projection 142*a* is substantially in contact with the path of the projection 144*a* indicated by the chain line. When the main cam member 50 rotates in the type selection process, the set lever 122 and the sheet holding roller 70, along with the rocking frames 14 and 16, are lowered by the urging cam surface 50*b* of the member 50. Thus the roller 70 touches the feed drive roller 74 to hold the printing sheet F. Thereupon, selection of a first desired type is executed. In this state, the set lever 122 in the first shift position is subjected to a clockwise rocking force by means of the leaf spring 140. Meanwhile, the stop pin 136 is not fully disengaged from the first step portion 122*a* yet, and is prevented from reaching the second step portion 122*b* by the upper end edge portion of the vertical portion 122*c*, as indicated by the full line in FIG. 8. Thus, the set lever 122 is kept in the first shift position of FIG. 7.

Subsequently, when the printing cam surface 50*c* of the main cam member 50 enters the angular range for the printing process, the rocking frames 14 and 16 are further lowered, so that the stop pin 136 is situated above the first step portion 122*a*, as indicated by the chain line in FIG. 8. Accordingly, the set lever 122 is rocked clockwise by the urging force of the leaf spring 140, so that the pin 136 moves to the second step portion 122*b*, as shown in FIG. 9. Thus, the set lever 122 is shifted to its second shift position. As a result, the projection 142*a* of the other leaf spring 142 is in sliding contact with the peripheral surface of the cam member 144. In this state, the printing operation is performed. In the case of this printer, the mark ¥ is printed as a first character.

Figure 8:
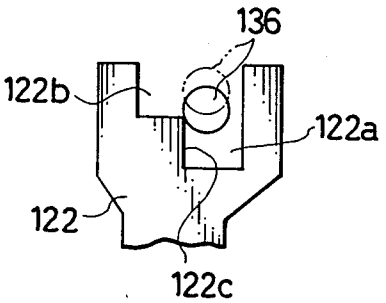
FIG. 8 is a partial enlarged view of a set lever shown in FIG. 7.

Those positions of the stop pin 136 indicated by full and chain lines in FIG. 8 are positions relative to the set lever 122. Actually, as seen from the description of the above embodiment, the set lever 122 moves relatively to the stop pin 136 which is fixed.

When the rocking frames 14 and 16 rise after the end of the printing operation, the stop pin 136 frictionally engages the second step portion 122*b*, since the set lever 122, this time, is in the second shift position. After this, the rocking frames 14 and 16 are prevented from rising, and are locked to the down position (FIG. 9) where the sheet holding rollers 68 and 70 are in the paper hold state. As the main cam member 50 rotates, thereafter, the cam follower 51 is separated at a narrow distance from the resetting cam surface 50*d*, since the radius of the surface 50*d* is shorter than that of the urging cam surface 50*b*. Thus, the stop pin 136 is kept firmly in engagement with the second step portion 122*b* by the agency of the lift spring 138.

As is also shown in the timing chart of FIG. 15, the aforesaid state is continuously maintained during individual intermediate printing cycles before the type carrying the last character to be printed, that is, the indelible end mark (*), is worked.

Figure 10:
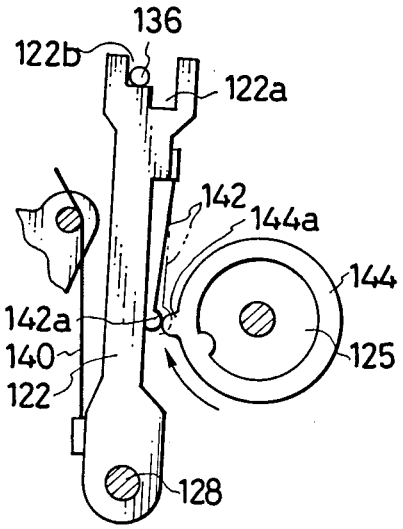
FIGS. 10 and 11 are enlarged views for illustrating the operation of the set lever portion shown in FIG. 9.

In the resetting operation for the type wheel 20, which is performed during the sheet feed process, the cam member 144 rotates while the type wheel 20 is rotating for resetting after being disengaged from the stopper lever 54. Thus the projection 144*a* of the cam member 144 may sometimes engage the projection 142*a* of the leaf spring 142 when the former passes by the latter, as shown in FIG. 10. Since the force of engagement between the pin 136 and the second step portion 122*b* is so great, however, that only the leaf spring 142 undergoes nothing but elastic deformation, as shown in FIG. 10, thus keeping the set lever 122 from moving from the second shift position.

Thus, the set lever 122 is held in the rocked position or the second shift position shown in FIG. 9 during the continuation of a series of printing cycles. During this period, therefore, the printing sheet F can be continually held in position as it is fed gradually in the sheet feed direction. Accordingly, there is no possibility of irregular printing or defective sheet feed, such as dislocation of the sheet.

Figure 11:
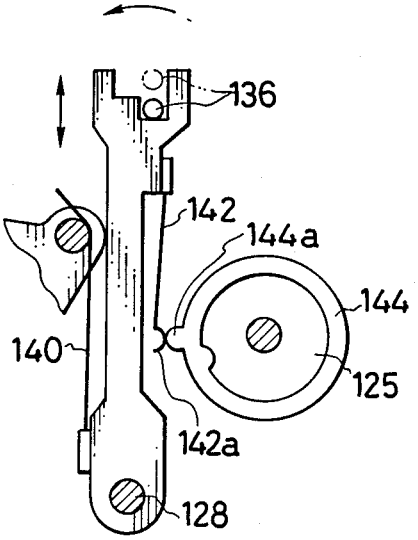

When the final cycle of printing operation is reached, the end mark (*) may be selected and printed as a specific character. In this case, when the type carrying this mark is situated in the printing position corresponding to the printing stump 88, during the type selection process, the projection 144*a* of the cam member 144 is set in the position where it just engages the projection 142*a* of the leaf spring 142, as shown in FIG. 11. Accordingly, a counterclockwise force from the leaf spring 142 acts on the set lever 122.

Since the stop pin 136 is in frictional engagement with the second step portion 122*b*, however, the set lever 122 cannot be rocked in the type selection process. When the rocking frames 14 and 16 are further lowered at the start of the printing operation, the aforesaid engagement is removed, so that the action of the leaf spring 142 becomes effective. Thereupon, the urging force of the spring 142, overcoming that of the leaf spring 140, causes the set lever 122 to rock counterclockwise. Thus, the pin 136 is situated in the position corresponding to the upper part of the first step portion 122*a*, as indicated by the chain line in FIG. 11.

When the rocking frames 14 and 16 are returned upward at the end of the printing operation, the pin 136 naturally engages the first step portion 122*a*, thus permitting the return to the up position. In this state, the printing sheet F, having undergone the printing operation, can be removed freely from the printer.

The resetting cam surface 50*d* of the main cam member 50 is an essential element of the arrangement for returning the rocking frames 14 and 16 securely to the up position.

Before the type wheel 20, after the end of the printing operation, starts the resetting rotation, that is, before the projection 144*a* of the cam member 144 is disengaged from the projection 142*a* of the leaf spring 142, the cam surface 50*d*, in conjunction with the cam follower 51, raises the rocking frames 14 and 16 until the pin 136, moving from the chain-line position of FIG. 8, reaches the full-line position. Thus, even though subjected to the clockwise force from the leaf spring 140, after the aforesaid disengagement, the stop pin 136 cannot return to the side of the second step portion 122*b*, since it is already in the first step portion 122*a* and is arrested by the vertical portion 122*c*. The timing for the operation of the resetting cam surface 50*d* is set in this manner.

The type selection process and the printing process of the aforementioned printer will now be summarized.

If printing data, such as a predetermined amount of money, is inputted through the input section 2, and when the motor 30 is connected to the power supply, as mentioned before, the type selection process is started. The rotation of the motor 30 is transmitted through the drive transmission means 32 to the main gear 40, the main shaft 48, and the main cam member 50, thereby rotating these members in one. As a result, the stopper lever 54 engages the engaging projection 116, thereby releasing the reference tooth 22*b*, so that the type wheel 20 and the type wheel gear 42 are rotated together.

At the same time, a start pulse is delivered by means of the control switch 104, and a solenoid 0N signal is delivered at a position corresponding to the inputted character. The stopper lever 54 causes the ratchet wheel 22 to engage the selected tooth 22*a* corresponding thereto, thereby stopping the type wheel 20. Thereafter, the type wheel gear 42 rotates slipping.

In the meantime, the urging cam surface 50*b* of the main cam member 50 corresponds in position to the cam follower 51, so that the rocking frames 14 and 16 are kept in the paper hold position, thus holding the printing sheet F to prevent dislocation thereof. During this period, the set lever 122 operates in the aforementioned manner.

Subsequently, in the printing process, the printing cam surface 50*c* of the main cam member 50, in conjunction with the cam follower 51, lowers the rocking frames 14 and 16 for printing operation at an angular position of 180°, and then raises the frames again. Thereupon, the rocking frames 14 and 16, in the paper hold state, starts a printing operation. Immediately after the frames 14 and 16 are further lowered, a solenoid OFF control pulse is delivered. The stopper lever 54 is held in the type selection position by the agency of the residual magnetism until the end of the printing operation. After the printing operation is completed, the lever 54 is forcibly removed from the type selection position by being engaged by the engaging projection 118. Thus, the stopper lever 54 is allowed to engage the reference tooth 22*b*.

In the meantime, the type wheel 20 is stopped by the stopper lever 54, and the type wheel gear 42 continues to rotate slipping as the main shaft 48 rotates. After disengagement from the stopper lever 54, the gear 42 rotates in one with the type wheel 20.

In the printing process, the set lever 122 operates in the aforementioned manner.

The sheet feed operation, along with the resetting operation performed in parallel therewith, will now be described.

The trigger lever 124 constitutes a type detecting member for detecting the comma (,) as a specific character. The lever 124 is urged by means of a spring 127 toward a cam member 125 which, having an engaging recess 125*a*, rotates in one with the type wheel 22. A projection 124*a* of the trigger lever 124 is adapted to engage the peripheral surface of the cam member 125. When a specific type carrying the specific character, i.e., the comma (,), is selected among the individual types of the type wheel 22, the projection 124*a* corresponds in position to the recess 125*a* of the cam member 125, as mentioned later.

The trigger lever 124 is in engagement with one end portion of the half-pitch feed control bar 84 which constitutes a sheet feed control member. The bar 84 is put, at the one end portion thereof, on the support shaft 134, and is combined, at the other end portion, with the sheet-feed operating bar 82 for relative movement in a manner such that a pin 146 is fitted in a slot 148.

When not in operation for half-pitch sheet feed adjustment, the half-pitch feed control bar 84 is held in a nonadjustment position by means of a spring 150, as shown in FIG. 7.

Meanwhile, the operating bar 82 is held in the position of FIG. 7 by means of a spring 152. In a regular sheet feed operation, the bars 82 and 84 in this state rock in one around the support shaft 134, resisting the urging force of the return spring 152, with a time lag corresponding to an angular lag of 120° behind the printing operation, as the main cam member 50 and the cam follower 120 engage each other. At their respective other end portions 82*a* and 84*a*, the bars 82 and 84 are in engagement with a rocking lever 154 of the sheet feed mechanism 80.

The operating lever 126 for half-pitch setting is caused continually to engage the driving cam member 52 by the urging force of the spring 156.

The driving cam member 52 and the operating lever 126 are shaped so that the timing for the drive of the lever 126 by the cam member 52 corresponds to the printing process and the sheet feed process (resetting process) of the main cam member 50, as seen from the timing chart of FIG. 15.

Figure 12:
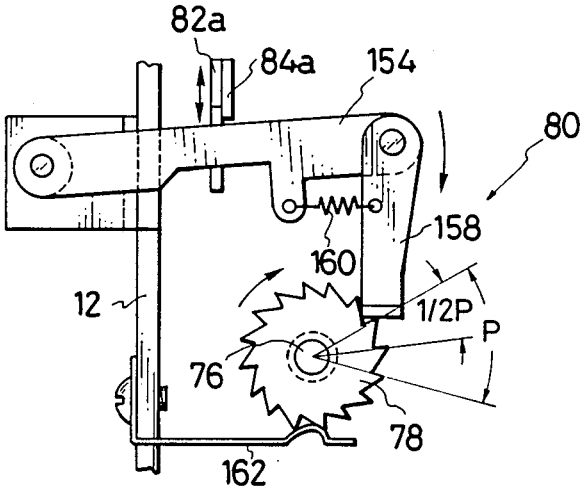
FIG. 12 is a partial view of a sheet feed mechanism.

In the sheet feed mechanism 80 shown in FIG. 12, the rocking lever 154 is pivotally mounted, at its base end portion, on the fixed frame 12, and a feed pawl 158 is pivotally mounted on the other end portion of the lever 154. The pawl 158 is caused continually to engage the sheet-feed ratchet wheel 78 by the urging force of a spring 160.

The wheel 78 is prevented from rotating unexpectedly by means of a leaf spring 162 supported on the fixed frame 12.

Thus, when the bars 82 and 84 rock so that their end portions 82*a* and 84*a* reciprocate for a fixed operation stroke, as indicated by the arrow of FIG. 12, the feed pawl 158 causes the ratchet wheel 78 to rotate by a pitch (p) equivalent to the feed pitch for one column, at a time. The moment of such rotation is transmitted through the transmission shaft 76 to the feed drive roller 74, whereupon the printing sheet F is fed in the regular mode.

As seen from the timing chart of FIG. 15, this sheet feed operation is started with the type wheel 20 separated entirely from the printing sheet F after the printing operation is completed. Thus, there is no possibility of dislocated printing or the sheet being soiled by rubbing against the type wheel.

If the character to be printed is the comma (,) or the like (comma in this embodiment), the sheet feed pitch may be made shorter than the regular feed pitch, in order to improve the appearance of the print and to prevent corruption. For example, the feed pitch for such a special character may be adjusted to half the regular pitch or ½p.

Figure 13:
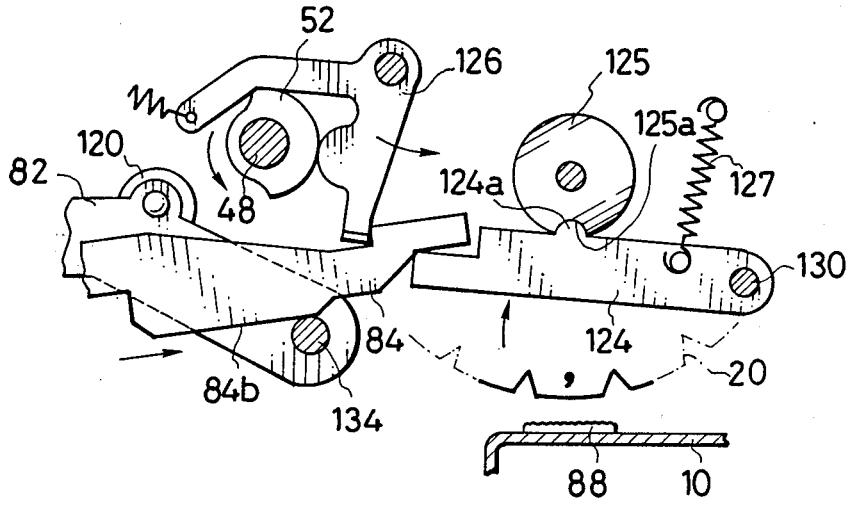
FIGS. 13 and 14 are partial views for illustrating the operation of the printer shown in FIG. 7.

Thus, if the comma is selected in the type selection process and when the type carrying the comma is situated in the printing position facing the printing stump 88, as shown in FIG. 13, the recess 125*a* of the cam member 125 just engages the projection 124*a* of the trigger lever 124. Accordingly, the lever 124 rocks so as to cause the one end portion of the half-pitch feed control bar 84 to interfere within the path of rocking motion of the operating lever 126.

Figure 14:
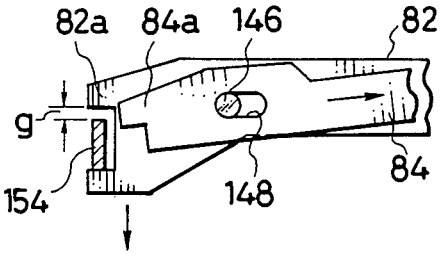

At the start of the printing process, the lever 126 is driven by the cam member 52 so that the half-pitch feed control bar 84 is slid from the nonadjustment position (FIG. 7) to an adjustment position in which the end portion 84*a* of the bar 84 is disengaged from the rocking lever 154, as shown in FIG. 14. In this state, a stepped lower end edge 84*b* of the bar 84 runs on the support shaft 134, and the cam member 52 holds the bar 84 in the adjustment position while rotating through a predetermined angular range (240°). After the printing, therefore, the type wheel 20 is disengaged from the stopper lever 54 and rotates for resetting in the sheet feed process (resetting process). Even though the trigger lever 124 is restored to the state of FIG. 7, the control bar 84 is restricted to the adjustment position. Thus, the operating lever 126, the cam member 52, and the support shaft 134 constitutes restriction means for holding the control bar 84 in the adjustment position.

Thus, when the sheet-feed operating bar 82 rocks in this state, the drive stroke is subject to a play (g) due to the absence of the half-pitch feed control bar 84, as shown in FIG. 14. As a result, the rocking stroke of the rocking lever 154 is reduced correspondingly, so that a limited feed pitch (½ pitch in this embodiment) can be obtained.

In this manner, the half-pitch sheet feed operation can be performed in the resetting process, and the sheet feed pitch can be automatically controlled by means of only a mechanical arrangement, without requiring any electrical detecting means.

The limited feed pitch is not limited to the ½ pitch, and may be set to any desired value, depending on the relationship with the teeth of the ratchet wheel 78.

Thus, in the sheet process, the predetermined regular pitch is used for the sheet feed for the printing of any other characters than the comma (,), while the half-pitch feed control bar 84 is slid to effect the half-pitch sheet feed for the printing of the comma.

During the sheet feed process described above, the type wheel 20 rotates for resetting until the reference tooth 22*b* engages the stopper lever 54, and is then stopped again in the reference position.

The drive motor 30 is adjusted so that when the printing cycle corresponds to the end mark (*), a motor OFF control pulse is delivered at an angular position of 320°, and the cam follower 51 is just caused to dwell on the dwell cam surface 50*a* of the main cam member 50 by the inertia of the motor 30.

The dwell cam surface 50*a* also serves as detent means for the positioning. Thus, the main cam member 50 is restored to its initial state. Meanwhile, the type wheel gear 42 and the type wheel 20 are restored to their initial relative positions such that the engaging projection 86*b* is fitted in the engaging recess 22*c*. Thereafter, the next printing cycle is started.

Various items in the left-hand columns of the timing chart of FIG. 15 will now be described.

This timing chart shows the modes of operation of various members achieved while the main shaft 48 and the main cam member 50 make one revolution, starting from the initial state.

First, the "TIMING PULSE" indicates a pulse which is delivered for each detected type position by the detecting disk 26 and the photosensor 28, in cooperation with each other, in the type selection process. The timing pulse serves to select a specific type and provide a solenoid ON timing for the solenoid device 56. The "CONTROL PULSE" indicates a pulse which is detected by means of the control switch 104 and is delivered with a timing corresponding to the rotational angle of the main shaft 48. The start pulse is delivered when the rotational angle is 0°, and the type position is identified in accordance with the count value of the timing pulses following the start pulse. The solenoid OFF pulse is delivered when the rotational angle is 150°, and the power supply to the drive motor 30 is cut off when the angle attains 320°. In the latter case, the motor 30 is given a motor OFF timing after the end of the printing of the last character. In consideration o the inertia of the motor 30, an angular range of 40° is provided for the secure stoppage or restoration of the motor to its initial state.

The "DEFLECTION OF ROCKING FRAME" indicates the rocking stroke of the rocking frames 14 and 16 lowering from their up position. The moment the printing cycle is started, the rocking frames are lowered to the position corresponding to the paper hold state. They are further lowered in the printing process. After the end of the printing operation, the paper hold state is maintained as indicated by the broken line in FIG. 15, if the printed character is any other character than the end mark (*). When printing the end mark, the rocking frames 14 and 16 are restored to the up position, where the printing sheet is released.

The "SHEET FEED OPERATION" indicates the rocking stroke of the sheet-feed operating bar 82 obtained through the engagement between the main cam member 50 and the cam follower 120. As illustrated, the bar 82 is operated after a time lag corresponding to an angle of 120° from the position for the printing operation.

The "STOPPER LEVER" indicates the rotational position of the stopper lever 54 obtained through the cooperation of the solenoid device 56 and the paired engaging projections 116 and 118 of the main gear 40. Immediately after the start, the stopper lever 54 runs on the reference tooth **22*b* by engaging the projection 116, thereby releasing the tooth 22*b*. By the solenoid device 56, the lever 54 is rocked to and held in the type selection position selected in the type selection process. The lever 54 is held in the same selection position by the residual magnetism until it engages the other projection 118 after the solenoid is turned off at the angular position of 150°. By engaging the projection 118, the lever 54 releases that tooth 22*a* of the ratchet wheel 22 which corresponds to the selected type, and is held in a position short of the reference tooth 22*b*. In the sheet feed process (resetting process), the lever 54 engages the reference tooth 22*b*, thereby stopping the type wheel 20**.

The "HALF-PITCH FEED CONTROL BAR" indicates an arrangement such that the half-pitch feed control bar 84 is slid relatively to the sheet-feed operating bar 82 for half-pitch sheet feed, as indicated by the full line in FIG. 15, only if the comma (,) is selected in the printing or sheet feed process, and that the bar 84 is held if any other character is selected.

The "SET LEVER" indicates a state such that the set lever 122 selectively engages the stop pin 136, thereby situating the pin 136 in the first or second step portion **122*a* or 122*b*. As mentioned before, the rocking state of the lever 122** varies depending on the selection among the characters of different categories, including the first character (¥) to be printed, middle characters, e.g., figure (4), and the end mark (*) as the last character. Thus, the lever 122 is held in the rocking position corresponding to the second step portion **122*b*** during the time interval which elapses from the instant the first character (¥) starts to be printed until the end mark (*) is printed. During this period, therefore, the paper hold state is maintained. In printing the end mark, the lever 122 is rocked to the position corresponding to the first step portion **122*a*, by the action of the leaf spring 142, immediately after the start of the printing operation. Before the release of the selected tooth from the stopper lever 54, moreover, the stop pin 136 is already fitted fully in the first step portion 122*a* and is arrested by the vertical portion 122*c*. As a result, the rocking frames 14 and 16** can be securely restored to the up position.

Finally, the "TYPE WHEEL" indicates the rotating and standstill states of the type wheel 20, with respect to the first character (¥) to be printed, middle types, e.g., figure (4), and end mark (*).

During the rotation for type selection, in this connection, the type wheel 20 rotates in one with the type wheel gear 42 until it is stopped by the rocking action of the stopper lever 54 caused when the solenoid is turned on. In the standstill state, the engaging projection **86*b* is disengaged from the engaging recess 22*c*, so that the gear 42** rotates slipping.

The resetting operation is started when the selected tooth is released from the stopper lever 54. The type wheel 20 rotates in one with the type wheel gear 42 in a manner such that the resilient piece **86*c* of the resilient engaging member 86 is pressed against the inner peripheral surface of the ratchet wheel 22. When the reference tooth 22*b* is stopped at the reference position by the stopper lever 54, only the type wheel gear 42 rotates slipping, and it stops at the position where the engaging projection 86*b* of the resilient engaging member 86 engages the engaging recess 22*c* of the ratchet wheel 22. Thereupon, the predetermined relative positions (FIG. 3) of the type wheel 20 and the type wheel gear 42** are settled, and the initial state is restored.

Thus, while one character is printed, the type wheel 20 makes one revolution, and the type wheel gear 42 makes three revolutions.

Also in the printing cycle for the comma, the type wheel 20 rotates for resetting through a predetermined angular range, so that the type carrying the comma moves from the printing position. The half-pitch feed control bar 84, however, is held in the adjustment position all during the printing process (resetting process) by the aforementioned restriction means, as seen from the timing chart of FIG. 15. Accordingly, the half-pitch sheet feed operation can be securely performed without being influenced by the reset rotation.

Figure 16:
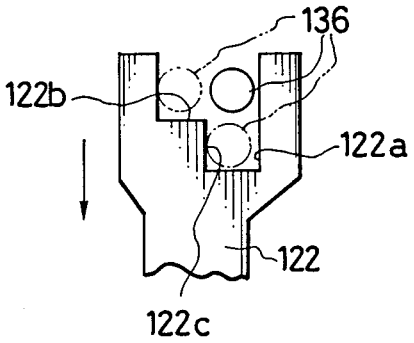
FIG. 16 is an enlarged view of a principal mechanism showing a modification of the arrangement of the set lever and a stop pin according to the present invention.
Figure 17:
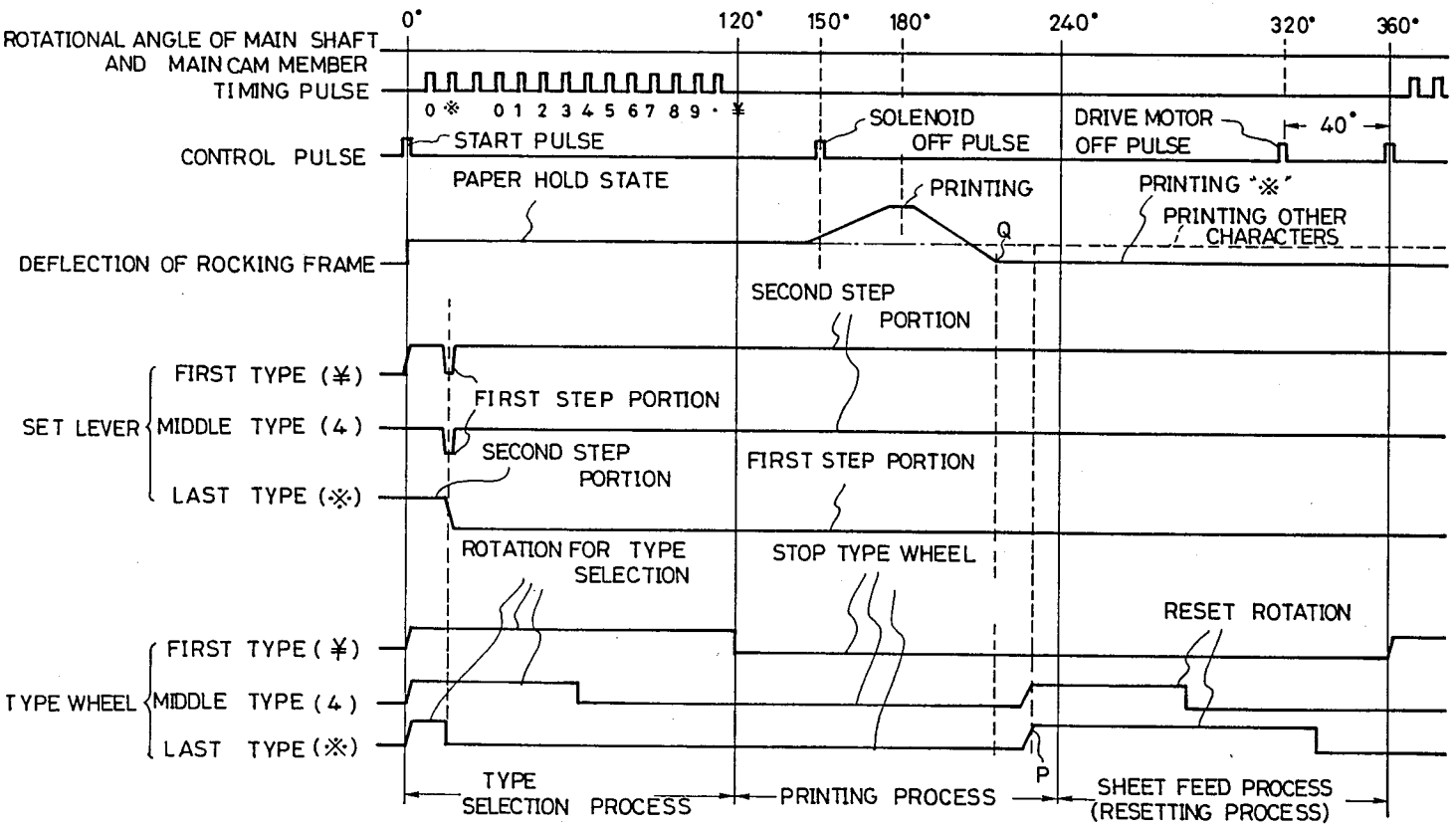
FIG. 17 is a timing chart corresponding to the modification of FIG. 16.

Referring now to FIGS. 16 and 17, a modification of the arrangement of the set lever 122, for use as the position setting member, and the stop pin 136 as the retaining member will be described.

In this modification, the radius R1 of the urging cam surface **50*b* (FIG. 6) of the main cam member 50 is a little longer than that in the foregoing embodiment. When the urging cam surface 50*b* is reached at the start of the printing of the first character, the set lever 122 lowers so that the stop pin 136 rises relatively to the lever 122, from the initial position, indicated by dashed line in FIG. 16, to a position just above the level of the second step portion 122*b***, as indicated by the full line.

In this case, the pin 136 moves relatively to the position (second shift position) indicated by the two-dot chain line in FIG. 16 so that the lever 122 is caused to correspond to the second step portion **122*b* by the action of the leaf spring 140 immediately after the start of the type selection process. In printing any other character than the end mark, the set lever 122 is held in the second shift position corresponding to the second step portion 122*b***, so that the paper hold state can be maintained in the same manner as in the aforementioned embodiment.

When the end mark passes once through the printing position while the type wheel 20 is rotating in the type selection process, however, the projection **144*a* of the cam member 144 instantaneously causes the set lever 122, not in frictional engagement with the pin 136, to rock to the first shift position, as is also shown in the timing chart of FIG. 17 At this time, however, the rocking frames 14 and 16 are held in the urging position by the urging cam surface 50*b* of the main cam member 50, so that the lever 122 is restored immediately to the second position by the action of the leaf spring 140**. Thus, the operation suffers no trouble.

Subsequently, in printing the end mark, the type bearing the end mark is situated in the printing position in the type selection process. Thereupon, the projection **144*a* of the set lever 144 presses the set lever 122 with the aid of the leaf spring 142. At this time, the pin 136 is not in frictional engagement with the lever 122, so that the lever 122 is immediately rocked to and held in the first shift position corresponding to the first step portion 122*a***.

The projection **144*a* keeps on pressing the set lever 122 until the type carrying the end mark starts to rotate for resetting, that is, up to the timing indicated by symbol P in the timing chart of FIG. 17. Before starting the reset rotation at point P, the rocking frames 14 and 16 is already restored to the up position at point Q of FIG. 17, so that the pin 136 can enter securely into the first step portion 122***a*.

Even though the projection 144*a* is disengaged from the set lever 122 by the reset rotation, therefore, there is no possibility of the lever 122 returning to the position corresponding to the second step portion 122*b*.

In the embodiment and modification described above, the first and second step portions 122*a* and 122*b* are formed at those portions of the set lever 122 which selectively engage the stop pin 136. However, the present invention is not limited to this arrangement, and the essential part of the arrangement for this function includes the vertical portion 122*c* for retaining the set lever 122 in the first shift position, and that surface of the second step portion 122*b* for keeping the rocking frames in the down position which is adapted to engage the pin 136.

Alternatively, the set lever 122, for use as the position setting member, may be provided on the side of the fixed frame 12. In this case, the stop pin 136 as the retaining member is provided on the side of the rocking frames 14 and 16.

Thus, the serial printer according to the present invention may be applied not only to checkwriters but also to numbering machines or any other suitable apparatuses.

What is claimed is:

1. A serial printer, comprising:

a fixed frame;

a rocking frame supported by one end of the fixed frame and rockable relatively to the fixed frame between a first position, in which a sheet passage for a printing sheet, defined between the fixed and rocking frames, is opened to allow the printing sheet to be inserted freely thereinto, and a second position, in which said sheet passage is closed, said rocking frame being further rockable from the second position to a third position on the opposite side thereof to the first position, said sheet passage being closed in the third position;

a sheet holding mechanism for applying a holding force to the printing sheet in the sheet passage as the rocking frame rocks from the first position to the second and third positions;

a single drive motor;

a single type wheel rotatably supported by the rocking frame and having its axis of rotation fixed with respect to the rocking frame, said type wheel being unable to move along the axis of rotation thereof;

rotary drive transmission means disposed on the rocking frame and transmitting the rotatory force of the drive motor to the type wheel, thereby rotating the type wheel, said transmission means including a main rotating member having at least three separate rotational angular ranges, including first, second, and third ranges, within an entire 360 degree rotation thereof;

a type selection mechanism for performing type selection on the type wheel in cooperation with the main rotating member while said rotating member is rotating through the first rotational range;

a printing mechanism for performing printing operation by means of the type wheel by rocking, in cooperation with the main rotating member, the rocking frame from the second position to the third position while said main rotating member is rotating through the second rotational angular range next to the first rotational angular range; and a sheet feed mechanism for performing sheet feed operation to feed the printing sheet in the sheet passage along a print line which is substantially parallel to said axis of rotation of the type wheel, in cooperation with the main rotating member, while said main rotating member is rotating through the third rotational angular range next to the second rotational angular range.

2. The serial printer according to claim 1, wherein said main rotating member of said rotary drive transmission means includes a main shaft rotatably supported by the rocking frame, and a single main cam rotatable in one with the main shaft and having an outer peripheral cam surface of a predetermined shape.

3. A serial printer, comprising:

a fixed frame;

a rocking frame having a base end portion pivotally supported by one end of the fixed frame and rockable relatively to the fixed frame between a first position, in which a sheet passage for a printing sheet, defined between the fixed and rocking frames is opened to allow the printing sheet to be inserted freely thereinto, and a second position, in which said sheet passage is closed, said rocking frame having a free end portion corresponding to the other end portion of the fixed frame, said rocking frame being further rockable from the second position to a third position on the opposite side thereof to the first position, said sheet passage being closed in the third position;

a sheet holding mechanism for applying a holding force to the printing sheet in the sheet passage as the rocking frame rocks from the first position to the second and third positions;

a single drive motor provided on the base end portion of the rocking frame;

a single type wheel rotatably supported on the free end portion of the rocking frame and having its axis of rotation fixed with respect to the rocking frame;

rotary drive transmission means disposed on the rocking frame and transmitting the rotatory force of the drive motor to the type wheel, thereby rotating the type wheel, said transmission means including a main rotating member having at least three separate rotational angular ranges, including first, second, and third ranges, within an entire 360 degree rotation thereof;

said main rotating member including a main shaft rotatably supported by the rocking frame, and a single main cam rotatable in one with the main shaft and actuatable on said rocking frame to cause the rocking frame to rock from said first portion, said main shaft and said main cam being disposed on the rocking frame so as to be situated between the drive motor and the type wheel;

a type selection mechanism for performing type selection on the type wheel in cooperation with the main rotating member while said rotating member is rotating through the first rotational range;

a printing mechanism for performing printing operation by means of the type wheel following further rocking movement of the rocking frame by the action of said main cam from the second position to the third position, while said main rotating member is rotating through the second rotational angular range next to the first rotational angular range; and a sheet feed mechanism for performing sheet feed operation to feed the printing sheet in the sheet passage along a print line, in cooperation with the main rotating member, while said main rotating member is rotating through the third rotational angular range next to the second rotational angular range.

4. The serial printer according to claim 3, wherein said drive motor is formed of a DC motor.

5. The serial printer according to claim 3, wherein said rotary drive transmission means includes a gear train having a predetermined rotating speed ratio.

6. The serial printer according to claim 5, wherein said rotating speed ratio is a ratio of 1 to 3 such that the type wheel makes three revolutions while the main shaft makes one revolution.

7. The serial printer according to claim 3, wherein said type selection mechanism includes optical detection means for detecting individual type positions on the type wheel, and solenoid means for stopping a type, selected in response to a detection signal from the detection means, at a printing position, said detection means having a detecting disk rotatable in one with the type wheel.

8. A serial printer, comprising:

a fixed frame;

a rocking frame supported by the fixed frame and rockable relatively to the fixed frame between a first position, in which a sheet passage for a printing sheet, defined between the fixed and rocking frames, is opened to allow the printing sheet to be inserted freely thereinto, and a second position, in which said sheet passage is closed, said rocking frame being further rockable from the second position to a third position on the opposite side thereof to the first position, said sheet passage being closed in the third position;

a sheet holding mechanism for applying a holding force to the printing sheet in the sheet passage as the rocking frame rocks from the first position to the second and third positions;

a single drive motor;

a single type wheel rotatably supported by the rocking frame and having its axis of rotation fixed with respect to the rocking frame;

rotary drive transmission means disposed on the rocking frame and transmitting the rotary force of the drive motor to the type wheel, thereby rotating the type wheel, said transmission means including a main rotating member having at least three separate rotational angular ranges, including first, second, and third ranges, with an entire 360 degree rotation thereof;

a type selection mechanism for performing type selection on the type wheel in cooperation with the main rotating member while said rotating member is rotating through the first rotational range;

a printing mechanism for performing printing operation by means of the type wheel by rocking, in cooperation with the main rotating member, the rocking frame from the second position to the third position while said main rotating member is rotating through the second rotational angular range next to the first rotational angular range;

a sheet feed mechanism for performing sheet feed operation to feed the printing sheet in the sheet passage along a print line, in cooperation with the main rotating member, while said main rotating member is rotating through the third rotational angular range next to the second rotational angular range; and said sheet holding mechanism including sheet holding roller means adapted to be kept disengaged from the sheet in the sheet passage when the rocking frame is in the first position, and to engage and hold down the sheet when the rocking frame is in one of the second position and the third position; a position setting member attached to one of the fixed and rocking frames so as to be situated between the frames, and shiftable between first and second shift positions; a retaining member attached to the other of the fixed and rocking frames, and adapted in cooperation with the position setting member, to allow the rocking frame to rock to the first position when the setting member is in the first shift position, and to hold the rocking frame in the second position when the setting member is in the second shift position; first urging means for urging the position setting member toward the second shift position; and second urging means adapted to urge the position setting member, against the urging force of the first urging means, toward the first shift position when a specific type of the type wheel is situated in a printing position, whereby the printing sheet is kept subjected to an urging force from the sheet holding mechanism until the specific type of the type wheel reaches the printing position, during the sheet feed operation by the sheet feed mechanism.

9. The serial printer according to claim 8, wherein said position setting member and said retaining member are attached to the rocking frame and the fixed frame, respectively.

10. The serial printer according to claim 9, wherein said first urging means is composed of a spring member.

11. The serial printer according to claim 10, wherein said second urging means includes a cam member rotatable in one with the type wheel, and having an engaging projection adapted to urge the position setting member toward the first shift position when the specific type is situated in the printing position.

12. The serial printer according to claim 11, wherein said second urging means includes a leaf spring member interposed between the cam member and the position setting member.

13. The serial printer according to claim 12, wherein said retaining member is formed of a pin protruding from the fixed frame, and said position setting member is formed of a lever having its base end portion pivotally supported on the rocking frame, said lever being formed, at the free end portion thereof, with a step portion capable of selectively engaging the pin.

14. The serial printer according to claim 13, wherein said sheet holding roller means includes a first sheet holding roller attached to the rocking frame, and a second sheet holding roller attached to the fixed frame so as to face the first sheet holding roller, said first and second sheet holding rollers being pressed against each other across the printing sheet in the sheet passage when the rocking frame is in one of the second position and the third position.

15. A serial printer, comprising:

a fixed frame;

a rocking frame supported by the fixed frame and rockable relatively to the fixed frame between a first position, in which a sheet passage for a printing sheet, defined between the fixed and rocking frames, is opened to allow the printing sheet to be inserted freely thereinto, and a second position, in which said sheet passage is closed, said rocking frame being further rockable from the second position to a third position on the opposite side thereof to the first position, said sheet passage being closed in the third position;

a sheet holding mechanism for applying a holding force to the printing sheet in the sheet passage as the rocking frame rocks from the first position to the second and third positions;

a single drive motor;

a single type wheel rotatably supported by the rocking frame and having its axis of rotation fixed with respect to the rocking frame;

rotary drive transmission means disposed on the rocking frame and transmitting the rotatory force of the drive motor to the type wheel, thereby rotating the type wheel, said transmission means including a main rotating member having at least three separate rotational angular ranges, including first, second, and third ranges, within an entire 360 degree rotation thereof.

a type selection mechanism for performing type selection on the type wheel in cooperation with the main rotating member while said rotating member is rotating through the first rotational range;

a printing mechanism for performing printing operation in a printing position by means of the type wheel by rocking, in cooperation with the main rotating member, the rocking frame from the second position to the third position, while said main rotating member is rotating through the second rotational angular range next to the first rotational angular range;

a sheet feed mechanism for performing sheet feed operation to feed the printing sheet in the sheet passage along a print line, in cooperation with the main rotating member, while said main rotating member is rotating through the third rotational angular range next to the second rotational angular range;

said sheet feed mechanism including sheet feed drive means engaging the main rotating member, thereby producing a fixed operation stroke corresponding to a predetermined sheet feed pitch, said drive means having a sheet feed control member movable between an adjustment position in which the control member adjusts the fixed operation stroke, thereby changing the sheet feed pitch, and a nonadjustment position in which the control member allows the operation stroke; restriction means capable of engaging the sheet feed control member so as to restrict the control member to the adjustment position; and a type detection member adapted to shift its position corresponding to a specific type of the type wheel and cause the control member to engage the restriction type of the type wheel and cause the control member to engage the restriction means when the specific type is situated in the printing position, whereby the printing sheet is fed with the adjusted pitch along the print line, with the specific type in the printing position; and said type detection member cooperating with a cam member rotatable in one with the type wheel and having a recess formed at a rotational position corresponding to the specific position, and having a projection adapted to engage the recess or the cam member, thereby shifting the position of the type detection member, when the projection corresponds in position to the recess.

16. The serial printer according to claim 15 wherein said restriction means includes a cam member rotating with the main rotating member, and an operating lever driven by said cam member so that the operating lever engages with the sheet feed control member so as to move the control member in the adjustment position, in cooperation with rotation of the cam member.

17. The serial printer according to claim 16, wherein said restriction means includes a shaft member engaging a stepped end edge of the sheet feed control member, when the sheet feed control member is moved to the adjustment position, so as to hold the control member in the position to engage the operating lever, independently of the type detection member.

18. A serial printer, comprising:

a fixed frame;

a rocking frame supported by the fixed frame and rockable relatively to the fixed frame between a first position, in which a sheet passage for a printing sheet, defined between the fixed and rocking frames, is opened to allow the printing sheet to be inserted freely thereinto, and a second position, in which said sheet passage is closed, said rocking frame being further rockable from the second position to a third position on the opposite side thereof to the first position, said sheet passage being closed in the third position;

a sheet holding mechanism for applying a holding force to the printing sheet in the sheet passage as the rocking frame rocks from the first position to the second and third positions;

a drive motor;

a type wheel rotatably supported on the rocking frame and having its axis of rotation fixed with respect to the rocking frame, said type wheel having a plurality of types thereon, which include a specific type;

a rotary drive transmission mechanism disposed on the rocking frame and transmitting the rotatory force of the drive motor to the type wheel, thereby rotating the type wheel, said transmission mechanism including main rotating means having at least three separate rotational angular ranges, including first, second, and third ranges, within an entire 360 degree rotation thereof;

a type selection mechanism for performing type selection in cooperation with the main rotating means to select and set one type of the type wheel to a printing position while said rotating means is rotating through the first rotational range;

a printing mechanism for performing printing operation to print said selected type; on the printing sheet held in the sheet passage by rocking, in cooperation with the main rotating means, the rocking frame with the type wheel from the second position to the third position, while said main rotating means is rotating through the second rotational angular range next to the first rotational angular range;

a sheet feed mechanism for performing sheet feed operation to feed the printing sheet in the sheet passage along a print line, in cooperation with the main rotating means, while said main rotating means is rotating through the third rotational angular range next to the second rotational angular range, said sheet feed mechanism including:

sheet feed drive means engaged with and driven by the main rotating means, thereby producing a given operation stroke corresponding to a predetermined sheet feed pitch, said drive means having a sheet feed control member movable between an adjustment position in which the control member adjusts the given operation stroke, thereby changing the sheet feed pitch, and a nonadjustment position in which the control member allows the given operation stroke;

restriction means driven by said main rotating means and capable of engaging the sheet feed control member so as to move the control member to the adjustment position;

type detection means operatively connected to said sheet feed control member and able to take a detecting position in which said detection means urges the sheet feed control member to engage with the restriction means in response to said type detection means detecting said specific type on the type wheel being situated in the printing position; and holding means for holding the sheet feed control means so as to be engaged with the restriction means even after said type detection means leaves said detecting position.

* * * * *